US006860078B1

(12) United States Patent
Geisthardt

(10) Patent No.: US 6,860,078 B1
(45) Date of Patent: Mar. 1, 2005

(54) METHOD OF PROVIDING PRECUT TRIM PIECES FOR A STRUCTURAL SLIDING DOOR

(75) Inventor: Alan C. Geisthardt, Fon du Lac, WI (US)

(73) Assignee: Plyco Corporation, Elkhart Lake, WI (US)

( * ) Notice: Subject to any disclaimer, the term of this patent is extended or adjusted under 35 U.S.C. 154(b) by 9 days.

(21) Appl. No.: 10/283,800

(22) Filed: Oct. 29, 2002

(51) Int. Cl.[7] ..... E04C 2/00

(52) U.S. Cl. ..... 52/745.16; 52/656.4; 52/656.7; 52/716.1

(58) Field of Search ..... 52/745.16, 745.13, 52/656.7, 656.4, 716.1

(56) References Cited

U.S. PATENT DOCUMENTS 3,410,040 A * 11/1968 Biro et al. ..... 52/222
3,487,602 A * 1/1970 Braun et al. ..... 52/455
3,491,584 A * 1/1970 Selzer ..... 49/501
4,021,988 A * 5/1977 Edeus et al. ..... 52/656.4
4,164,105 A * 8/1979 Herbst et al. ..... 52/202
4,193,245 A * 3/1980 Johnson ..... 52/656.4
5,161,346 A * 11/1992 Olson et al. ..... 52/746.1
5,285,606 A * 2/1994 Hagemeyer ..... 52/204.68
6,050,036 A * 4/2000 Frey ..... 52/204.5

* cited by examiner

*Primary Examiner*—Brian E. Glessner
(74) *Attorney, Agent, or Firm*—Donald J. Ersler

(57) ABSTRACT

A method of providing precut trim pieces for a structural sliding door includes a vertical trim piece with one end that fits over a rail lip of a vertical rail, instead of under the rail lip. The rail lip terminates a trim extension of the vertical rail. Attaching the vertical trim piece over the rail lip enables the vertical trim piece to have horizontal adjustment relative to the trim extension. The manufacturer is able to supply precut lengths of horizontal and angled trim pieces, because the vertical trim piece may be horizontally adjusted to compensate for an out-of-square door.

6 Claims, 5 Drawing Sheets

METHOD OF PROVIDING PRECUT TRIM PIECES FOR A STRUCTURAL SLIDING DOOR

BACKGROUND OF THE INVENTION

1. Field of the Invention

The present invention relates generally to structural sliding doors and more specifically to a method of providing precut trim pieces for a structural sliding door that does not require the trim pieces to be custom cut by an installer at a job site.

2. Discussion of the Prior Art

A structural sliding door includes two vertical rails and a plurality of horizontal girts. The two vertical rails receive the plurality of horizontal girts. The plurality of horizontal girts are secured to the two vertical rails with fasteners. Preferably, a face plate is fastened to a front of the vertical rails and horizontal girts. A window may be formed in the structural sliding door. A plurality of trim pieces are attached to the face plate for enhancing the appearance of the structural sliding door. Since the structural sliding door is assembled at the job site, a builder will not always construct the structural sliding door perfectly square. The vertical rail includes a trim extension, which has a rail lip for receiving an end of a vertical trim piece. The rail lip does not allow the vertical trim piece to be horizontally positioned relative to the trim extension. The nonadjustability of the vertical trim piece requires that horizontal and angled trim pieces be custom cut to length at the job site. Custom cutting requires extra time and labor.

Accordingly, there is a clearly felt need in the art for a method of providing precut trim pieces for a structural sliding door, which allows precut trim pieces to be supplied by the manufacturer to the installer.

SUMMARY OF THE INVENTION

The present invention provides a structural sliding door with precut trim pieces. The method of providing precut trim pieces for a structural sliding door includes a vertical trim piece with one end that fits over a rail lip of a vertical rail, instead of under the rail lip. Attaching the trim piece over the rail lip enables the vertical trim piece to have horizontal adjustment relative to the trim extension. The manufacturer of the structural sliding door is able to supply precut lengths of horizontal and angled trim pieces, because the vertical trim piece may be horizontally adjusted to compensate for an out-of-square structural sliding door. If a window is installed in the structural sliding door, one end of the vertical trim piece is placed on the rail lip and the other end fits under a window casing.

Accordingly, it is an object of the present invention to provide a method of providing precut trim pieces for a structural sliding door that places the trim piece on top of a rail lip of a vertical rail instead of under the rail lip and allows all trim pieces to be precut.

These and additional objects, advantages, features and benefits of the present invention will become apparent from the following specification.

DETAILED DESCRIPTION OF THE PREFERRED EMBODIMENTS

Figure 2:
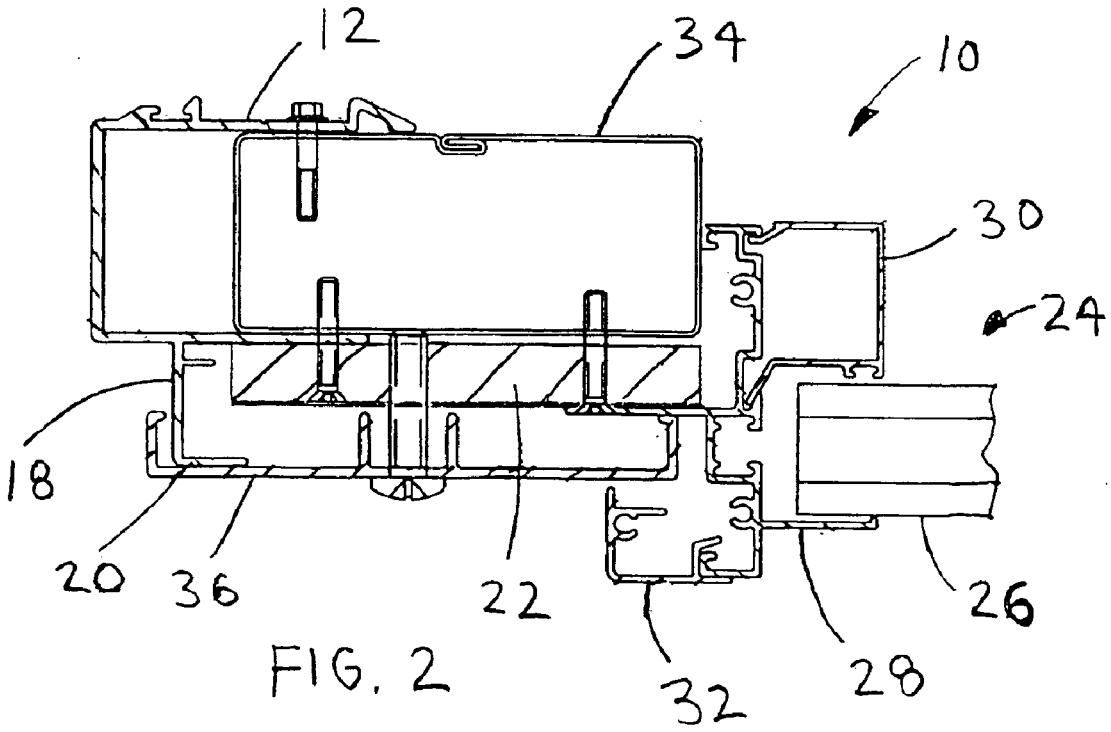
FIG. 2 is a cross sectional view of a vertical trim piece placed on a rail lip adjacent a window of a structural sliding door in accordance with the present invention.
Figure 4:
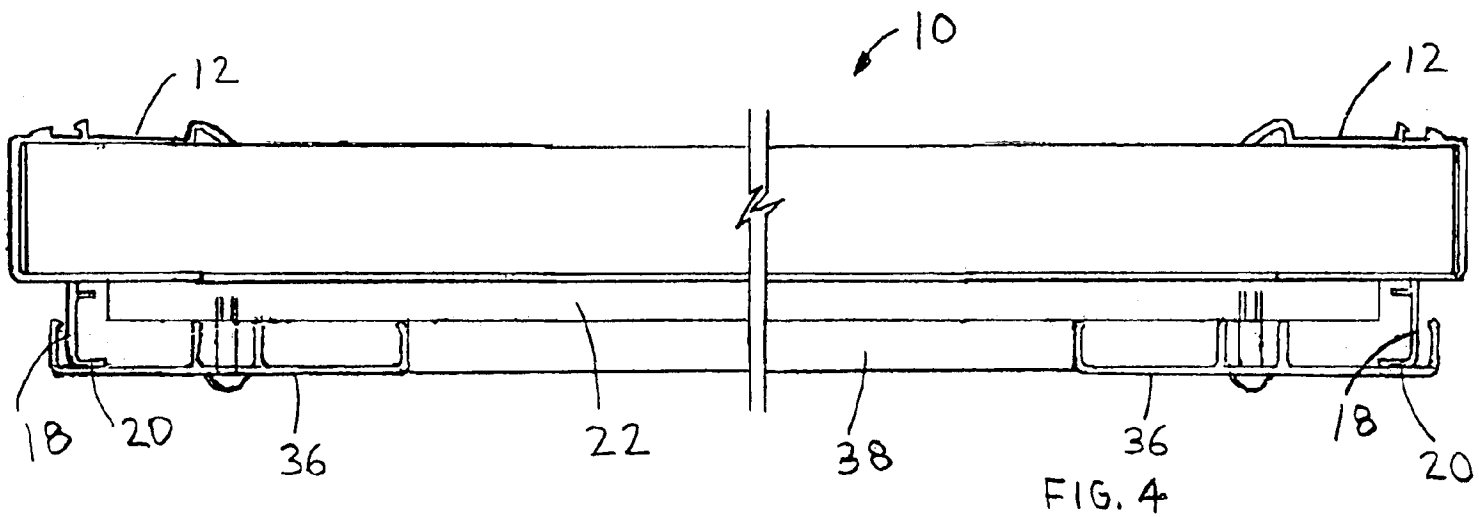
FIG. 4 is a top view of a structural sliding door with two vertical trim pieces and one horizontal trim piece in accordance with the present invention.
Figure 5:
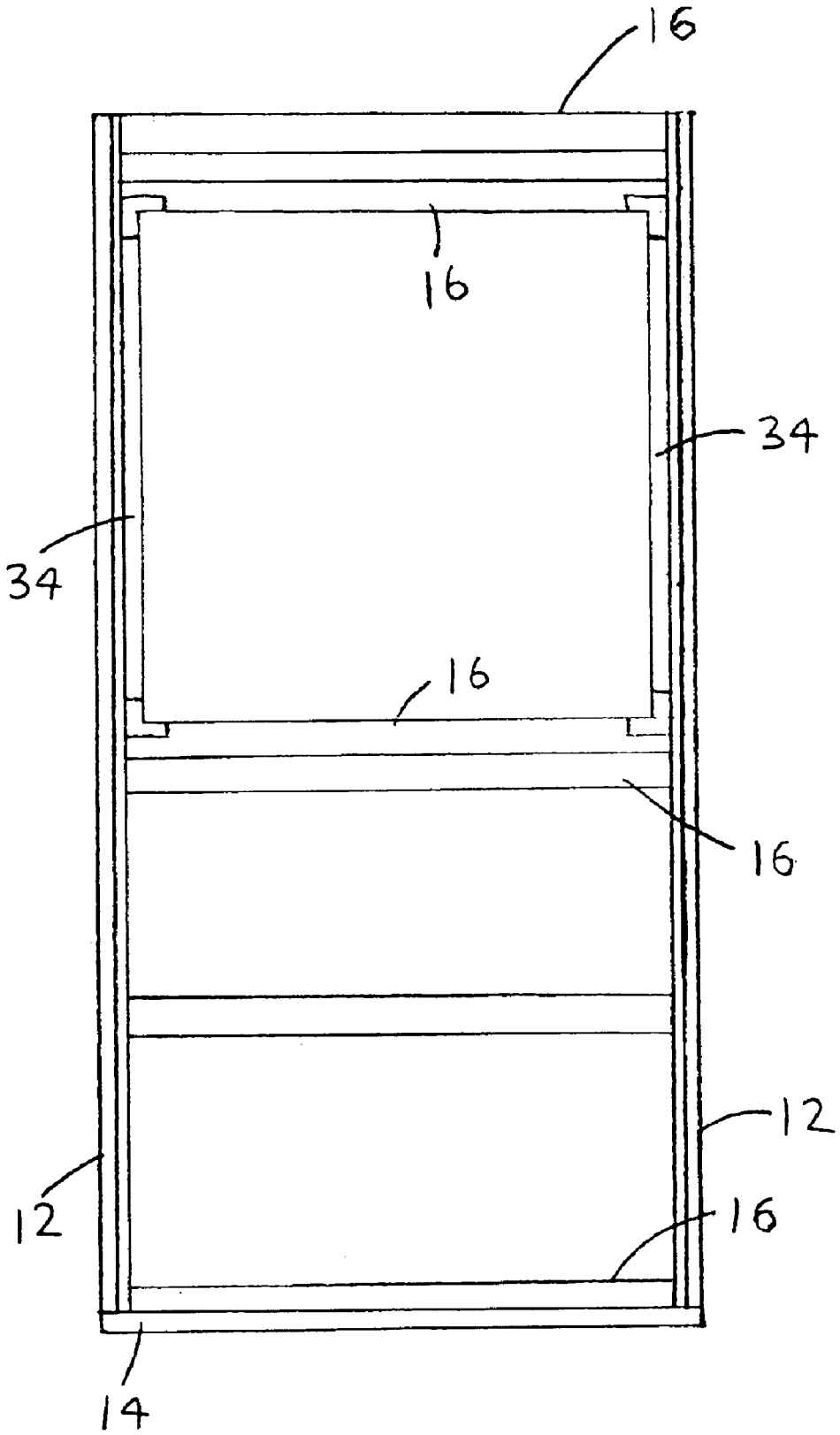
FIG. 5 is a front view of a structural sliding door without a face plate attached thereto in accordance with the present invention.
Figure 6:
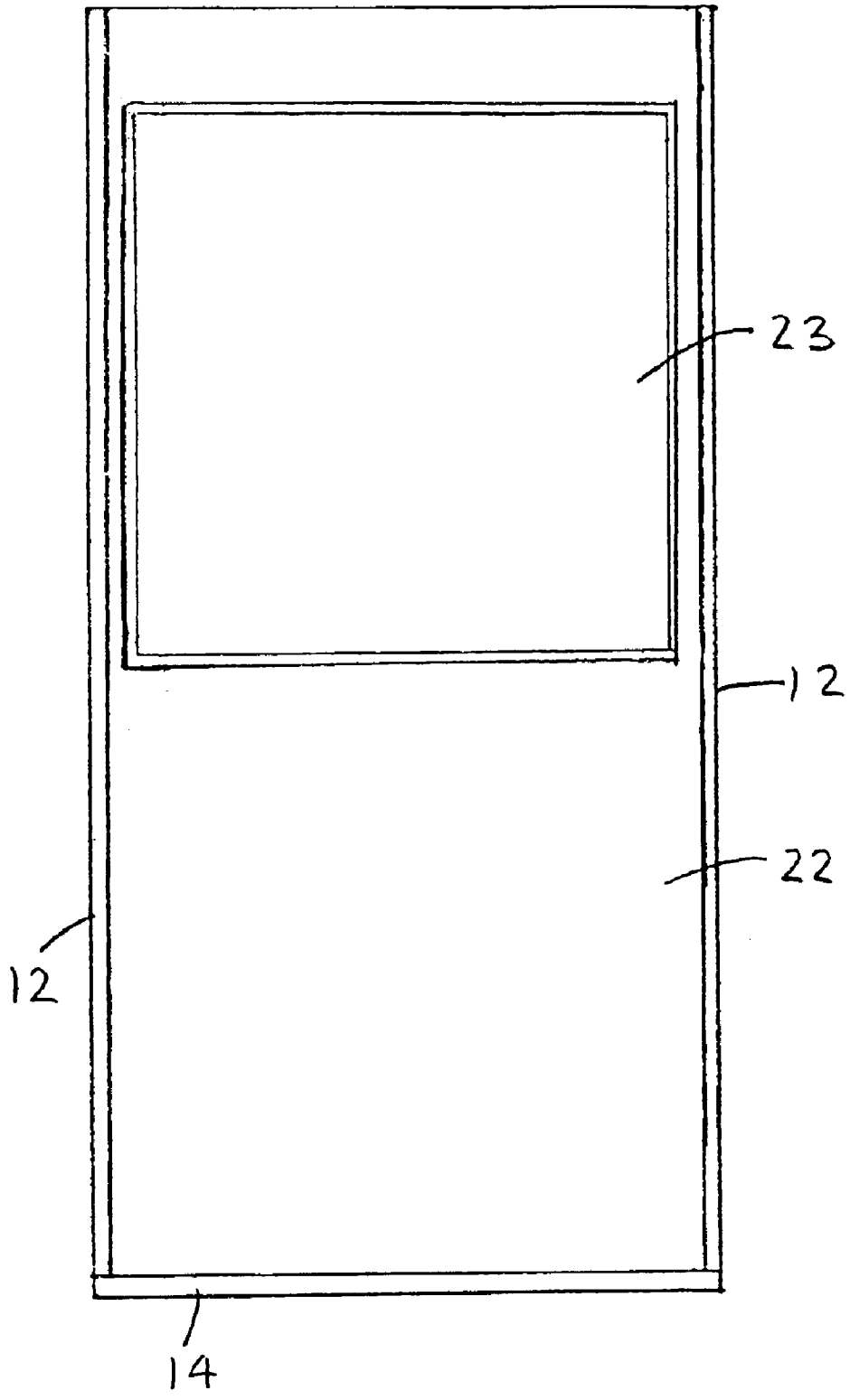
FIG. 6 is a front view of a structural sliding door with a face plate attached thereto in accordance with the present invention.

With reference now to the drawings, and particularly to FIG. 2, there is shown a cross sectional view of a portion of a structural sliding door 10. With reference to FIGS. 4–6, the structural sliding door 10 includes two vertical rails 12, a bottom rail 14, and a plurality of horizontal girts 16. Each vertical rail 12 includes a substantially U-shaped cross section which is sized to receive one end of the plurality of horizontal girts 16. The plurality of girts are preferably retained in the vertical rail 12 with fasteners. A trim extension 18 extends from a front of each vertical rail 12. Each trim extension 18 is terminated with a rail lip 20.

Figure 7:
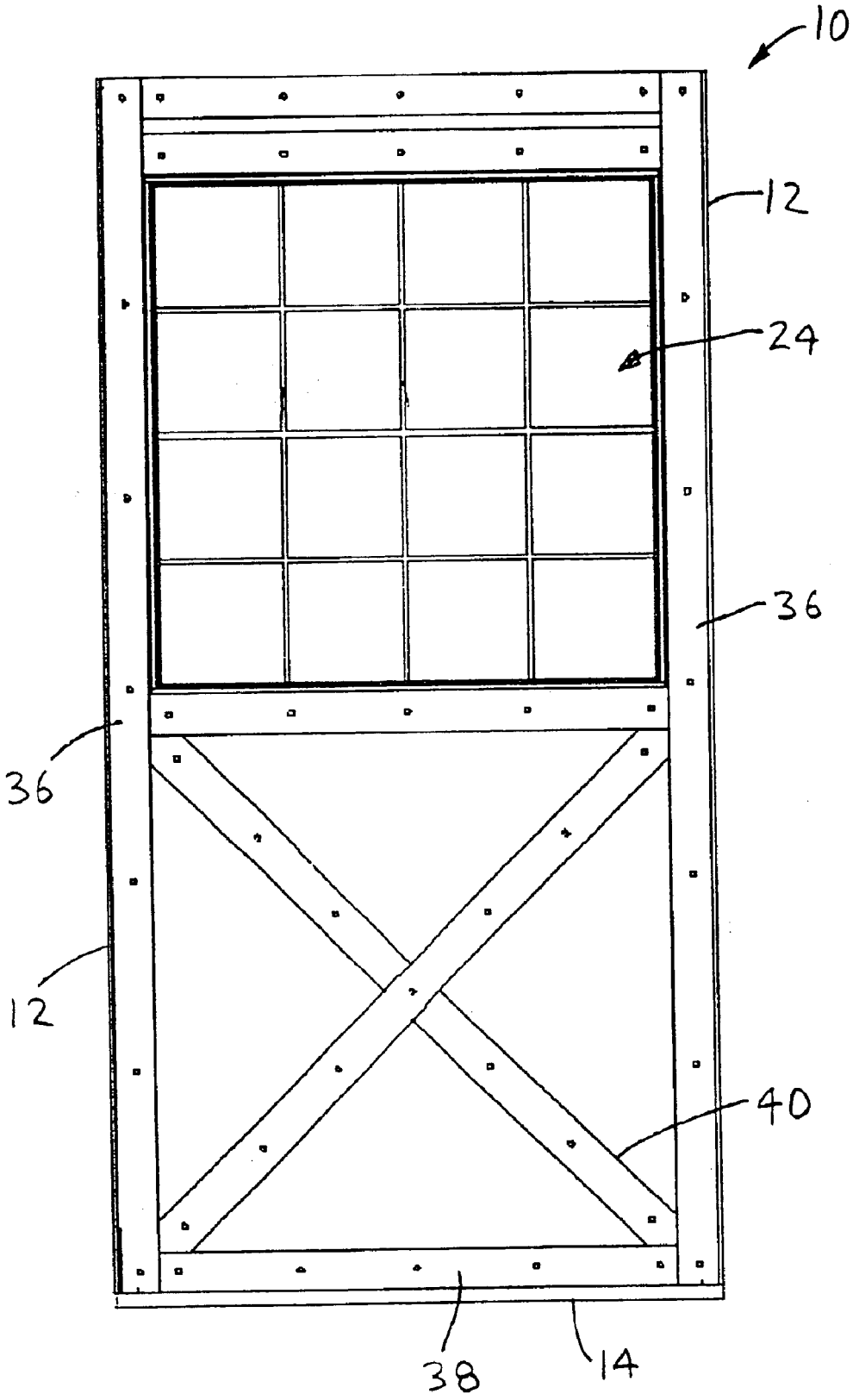
FIG. 7 is a front view of a structural sliding door with a face plate and trim pieces attached thereto in accordance with the present invention.

The two vertical rails 12 are preferably attached to a top of the bottom rail 14 with fasteners. A face plate 22 is attached to a front of the two vertical rails 12 and the plurality of horizontal girts 16. A window opening 23 may be formed through the face plate 22 to accommodate a window 24. The window 24 includes a pane of glass 26, a window sash 28, a window stop 30, and a window casing 32. A vertical girt 34 is preferably used to support the window 24. With reference to FIG. 7, two vertical trim pieces 36, a plurality of horizontal trim pieces 38, and cross trim pieces 40 are attached to the face plate 22 for enhancing the appearance of the structural sliding door 10.

Figure 1:
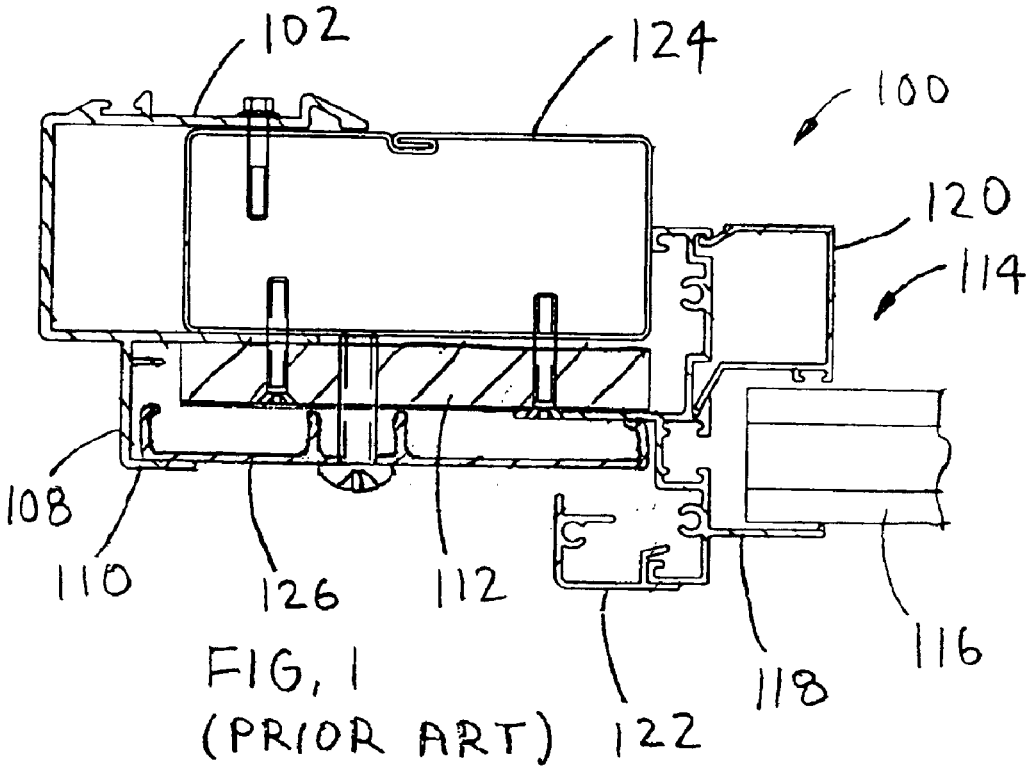
FIG. 1 (PRIOR ART)
FIG. 1 is a cross sectional view of a vertical trim piece retained by a rail lip adjacent a window of a prior art structural sliding door.
Figure 3:
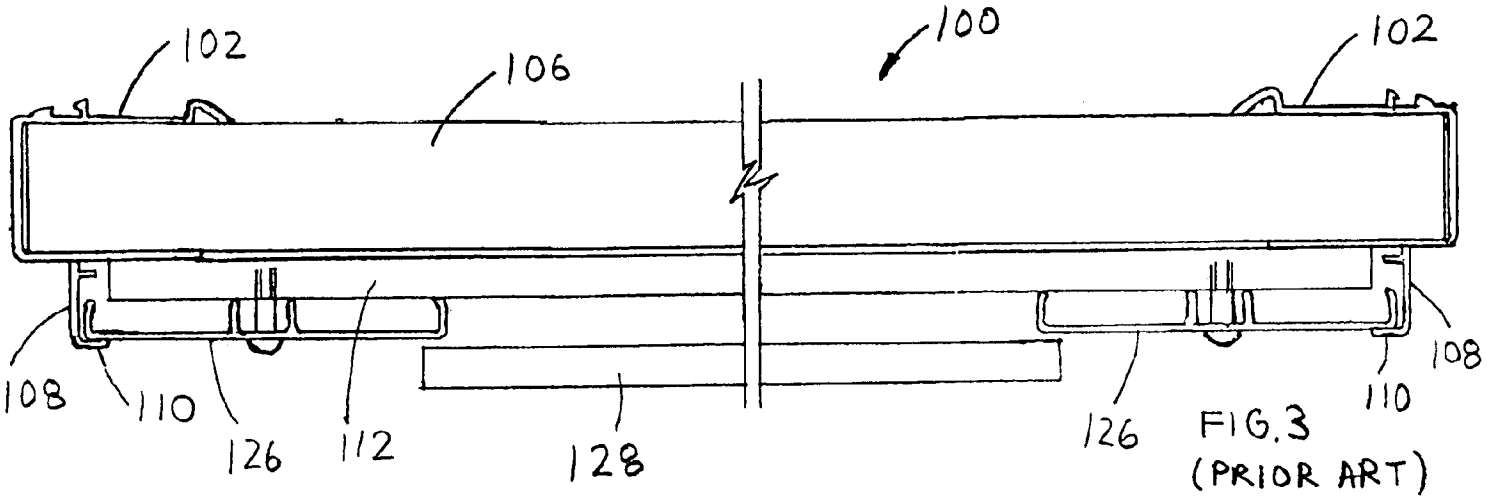
FIG. 3 (PRIOR ART)
FIG. 3 is a top view of a prior art structural sliding door with two vertical trim pieces and one horizontal vertical trim piece.

FIGS. 1 and 3 show a prior art structural sliding door 100. The structural sliding door 100 includes two vertical rails 102, a bottom rail (not shown), a plurality of horizontal girts 106. The plurality of horizontal girts 106 are retained in the two vertical rails 102. Each vertical rail 102 includes a substantially U-shaped cross section and a trim extension 108 that extends from a front of each vertical rail 102. Each trim extension 108 is terminated with a rail lip 110. The two vertical rails 102 are attached to a top of the bottom rail. A face plate 112 is attached to attached to a front of the two vertical rails 102 and the plurality of horizontal girts 106. A window 114 may be formed in the structural sliding door 100. The window 114 includes a pane of glass 116, a window sash 118, a window stop 120, and a window casing 122. A vertical girt 124 is preferably used to support the window 114.

The structural sliding door 10, 100 is assembled at the job site. The builder will not always construct the structural sliding door 10, 100 perfectly square. An out-of-square structural sliding door 10, 100 will require that the vertical trim piece 36, 126 be horizontally adjustable to compensate for the out-of-square condition. With reference to FIGS. 1 and 3, two vertical trim pieces 126 are retained under the rail lip 110. Retaining the two vertical trim pieces 126 under the rail lip 110 does not allow the vertical trim pieces 126 to be horizontally adjustable. A horizontal trim piece 128 must be custom cut at the job site by a builder, because thereof is too long to fit between the two vertical trim pieces 126.

However, with reference to FIGS. 2 and 4, the vertical trim pieces 36 are horizontally adjustable, because they are placed on rail lip 20 and then attached to the face plate 22. Standard lengths of horizontal trim pieces 38 may be manufactured without having to cut the length at the job site. The vertical trim pieces 36 must be in contact with the ends of the plurality of horizontal trim pieces 38 and cross trim pieces 40. A gap between the vertical trim pieces 36, the plurality of horizontal trim pieces 38 and the cross trim pieces 40 detracts from the appearance of the structural sliding door 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of providing precut trim pieces for a structural sliding door, comprising the steps of:

providing a first vertical rail and a second vertical rail, each said vertical rail having a substantially U-shaped cross section and a trim extension, said trim extension being terminated with a rail lip;

attaching said first vertical rail to one end of a bottom rail, attaching said second vertical rail to the other end of said bottom rail;

attaching a plurality of horizontal girts between said first and second vertical rails;

attaching a face plate to a front of said first vertical rail, said plurality of horizontal girts, and said second vertical rail;

attaching two vertical trim pieces to said face plate, each one of said two vertical trim pieces being placed on top of a single said rail lip, said two vertical trim pieces being horizontal adjustable relative to said rail lip; and attaching a plurality of horizontal trim pieces to said face plate having a precut length between said first and second vertical trim pieces, the ends of said plurality of horizontal trim pieces being in contact with said two vertical trim pieces.

2. The method of providing precut trim pieces for a structural sliding door of claim 1, further comprising the steps of:

attaching cross trim pieces having a precut length to said face plate between said first and second vertical trim pieces, the ends of said cross trim pieces being in contact with said first and second vertical trim pieces.

3. The method of providing precut trim pieces for a structural sliding door of claim 1, further comprising the steps of:

forming a window in said structural sliding door.

4. A method of providing precut trim pieces for a structural sliding door, comprising the steps of:

providing a first vertical rail and a second vertical rail, each said vertical rail having a substantially U-shaped cross section and a trim extension, said trim extension being terminated with a rail lip;

attaching said first vertical rail to one end of a bottom rail, attaching said second vertical rail to the other end of said bottom rail;

attaching a plurality of horizontal girts between said first and second vertical rails;

attaching a face plate to a front of said first vertical rail, said plurality of horizontal girts, and said second vertical rail;

attaching two vertical trim pieces to said face plate, each one of said two vertical trim pieces being placed on top of a single said rail lip, said two vertical trim pieces being horizontal adjustable relative to said rail lip;

attaching a plurality of horizontal trim pieces to said face plate having a precut length between said first and second vertical trim pieces, the ends of said plurality of horizontal trim pieces being in contact with said two vertical trim pieces; and attaching cross trim pieces having a precut length to said face plate between said first and second vertical trim pieces, the ends of said cross trim pieces being in contact with said first and second vertical trim pieces.

5. The method of providing precut trim pieces for a structural sliding door of claim 4, further comprising the steps of:

forming a window in said structural sliding door.

6. A method of providing precut trim pieces for a structural sliding door, comprising the steps of:

providing a first vertical rail and a second vertical rail, each said vertical rail having a substantially U-shaped cross section and a trim extension, said trim extension being terminated with a rail lip;

attaching said first vertical rail to one end of a bottom rail, attaching said second vertical rail to the other end of said bottom rail;

attaching a plurality of horizontal girts between said first and second vertical rails;

attaching a face plate to a front of said first vertical rail, said plurality of horizontal girts, and said second vertical rail;

attaching two vertical trim pieces to said face plate, each one of said two vertical trim pieces being placed on top of a single said rail lip, said two vertical trim pieces being horizontal adjustable relative to said rail lip;

attaching a plurality of horizontal trim pieces to said face plate having a precut length between said first and second vertical trim pieces, the ends of said plurality of horizontal trim pieces being in contact with said two vertical trim pieces;

attaching cross trim pieces having a precut length to said face plate between said first and second vertical trim pieces, the ends of said cross trim pieces being in contact with said first and second vertical trim pieces; and forming a window in said structural sliding door.

* * * * *